United States Patent [19]

Japs

[11] 4,099,376

[45] Jul. 11, 1978

[54] GAS GENERATOR AND SOLID PROPELLANT WITH A SILICON-OXYGEN COMPOUND AS A BURNING RATE MODIFIER, AND METHOD FOR MAKING THE SAME

[75] Inventor: Archie B. Japs, Akron, Ohio

[73] Assignee: The B. F. Goodrich Company, Akron, Ohio

[21] Appl. No.: 519,002

[22] Filed: Jun. 29, 1955

[51] Int. Cl.[2] ..... F02K 9/04; C06B 45/10

[52] U.S. Cl. ..... 60/253; 60/39.47; 149/19.4; 149/19.9; 149/19.92

[58] Field of Search ..... 52/0.5; 260/75 TN; 149/19.4, 19.9, 19.92; 60/39.47, 253

[56] References Cited

U.S. PATENT DOCUMENTS

| | | | |
|---|---|---|---|
| 2,159,234 | 5/1939 | Taylor | 52/0.5 |
| 2,621,166 | 12/1952 | Schmidt et al. | 260/75 |
| 2,649,439 | 8/1953 | Brown | 260/89.5 |
| 2,671,074 | 3/1954 | Brown | 260/80.7 |
| 2,740,702 | 4/1956 | Mace | 52/0.5 |
| 2,741,800 | 4/1956 | Brockway | 260/75 |

FOREIGN PATENT DOCUMENTS

| | | | |
|---|---|---|---|
| 655,585 | 7/1951 | United Kingdom | 52/0.5 |

*Primary Examiner*—Edward A. Miller
*Attorney, Agent, or Firm*—John H. Faro

EXEMPLARY CLAIM

2. An article of manufacture useful as a gas generator and comprising a container having an outlet and supported and adapted to burn within said container and adhered to the walls of said container a mixed, shaped and cured composition of matter characterized by generating large volumes of gas on combustion and, except for minor amounts of compounding ingredients, consisting essentially of from about 70 to 87% by weight of finely-divided dried ammonium perchlorate, from about 0.5 to 5.0% by weight of at least one high surface area finely-divided essentially anhydrous inorganic silicon and oxygen-containing burning rate modifier selected from the group consisting of silicon monoxide, fume silica, arc silica and silicon oxyimide, and the balance a combustible organic elastomeric polymeric binder selected from the group consisting of a cured polyesterurethane of an organic diisocyanate and a hydroxyl terminated polyester of a dibasic acid and a glycol and a polymer comprising predominantly linear carbon chains cured through at least a portion of its combined curable acid groups selected from the class consisting of COOH, $SO_3H$, $SO_2H$ and $PO_3H_2$ radicals.

3 Claims, No Drawings

GAS GENERATOR AND SOLID PROPELLANT WITH A SILICON-OXYGEN COMPOUND AS A BURNING RATE MODIFIER, AND METHOD FOR MAKING THE SAME

The present invention relates to improvements in ammonium perchlorate gas-generating compositions. In particular, this invention relates to a novel ammonium perchlorate composition having a high linear burning rate and desirable physical properties for use in propelling various devices, spray devices and the like, to a novel method of making said composition and to a novel article of manufacture containing such composition.

Conventional solid combustible gas-generating compositions containing oxygen required for combustion for producing large volumes of gas for spraying equipment, for propelling various devices, for motors and the like have required elevated processing temperatures to obtain compositions having only minimum physical properties. The temperatures required for processing and curing approach the autoignition point of the composition so that compounding is hazardous. Many of these prior art compositions are not stable and their physical and chemical properties change with time. Furthermore, even the best of the prior art compositions exhibit low linear burning rates so that it has not been easy to obtain the mass burning rate desired for certain applications.

Ammonium perchlorate has been known as an explosive material and as being potentially a good gas-generating composition. However, as pointed out above, conventional compositions utilizing this compound do not produce the highest linear burning rates, are not easy to process and do not have the desired physical properties.

Accordingly, it is a primary object of the present invention to provide an ammonium perchlorate gas-generating composition of matter which overcomes the difficulties alluded to in the prior art and which is characterized by relative easy processability and by high burning rates and satisfactory physical properties over an extended ambient temperature and pressure range.

Another object is to provide a solid ammonium perchlorate composition having a high linear burning rate and a high gas-producing efficiency.

Yet another object is to provide an article of manufacture containing a solid ammonium perchlorate gas-generating composition which exhibits exceptionally good physical properties and high gas-generating capacity.

A further object is to provide an article of manufacture containing a shaped cured solid ammonium perchlorate composition which is decomposable on heating to liberate large volumes of gas and which exhibits high linear burning rates even at high gas pressures, is stable and possesses good physical properties.

A still further object is to provide a method for mixing, forming and curing at safe temperatures a gas-generating composition comprising ammonium perchlorate and exhibiting excellent physical and chemical properties when cured.

Yet again an object of this invention is to provide a method for producing a solid high linear burning rate ammonium perchlorate gas-generating composition at relatively low processing and curing temperatures.

These and other objects and advantages of the present invention will become more apparent to those skilled in the art from the following detailed description and examples.

According to the present invention it has now been discovered that a highly useful gas-generating composition can be obtained by using a minor amount of a finely-divided high surface area essentially anhydrous inorganic silicon and oxygen-containing burning rate modifier in an ammonium perchlorate-organic binder gas-generating composition. The compositions disclosed herein can readily be prepared in a relatively short period of time at low temperatures. Some can also be cured at room temperatures in a reasonable length of time. Moreover, the compositions are sufficiently plastic to be molded or extruded to the desired shape. The cured compositions are stable and do not crack or break when exposed to temperature cycling of from about −65°to +175° F. and are strong, impact resistant, and shock resistant. On combustion or decomposition, the compositions liberate large quantities of gaseous products when burned in the absence of air or oxygen (other than that supplied by the composition itself) and exhibit very high linear burning rates, up to 2½inches per second, and even burn at gas pressures over 2,000 p.s.i.

THE BURNING RATE MODIFIER

The essentially anhydrous inorganic high temperature produced silicon and oxygen-containing burning rate modifier should be finely-divided and have a large surface area. It has been found that materials such as arc silica, fume silica, silicon monoxide or "Monox", and silicon-oxyimide are finely-divided and have a large surface area to provide high linear burning rates and sustained burning at high gas pressures. It is not precisely known why the burning rate modifiers disclosed herein provide such high burning rates in ammonium perchlorate-rubbery organic binder compositions since such modifiers have no appreciable effect in double base gas-generating compositions, i.e., those composed of essentially nitrocellulose and nitroglycerine, nor in compositions using other inorganic decomposable salts and organic binders. It may be that since the silicon-oxygen containing compounds are somewhat refractory in nature, they may act as a radiant body to absorb heat and bring up the temperature of the burning front of the composition. Moreover, the modifier apparently affects the mechanism of combustion since it not only provides higher linear burning rates and burning at higher gas pressures but also shows in some compositions at certain oxidizer concentrations a leveling off of the burning rates even though gas pressures are increased. This "Mesa" effect is obtained by plotting the burning rate against the gas pressure and is unexpected and in contrast to known modifiers in other gas-generating compositions where the burning rate tends to increase with increase in gas pressure and which accordingly increases the need for special design of the composition and control of the motor using the same. While the burning rate modifiers may vary somewhat as to their fineness and surface area, it is preferable to employ for each modifier particles of highest surface area and smallest size. A further important point is that these modifiers tend to reinforce or strengthen some or all of the binders in which they are incorporated. While not absolutely necessary, the modifiers may desirably be densified by treatment with an alcohol, etc., to aid in milling or mixing or surface treated witn an alkyl or aryl amine, a polyhalosilane, polyhydroxy organic compound and the like to improve their compatability and reinforcement of the binder. Of the various modifiers, it is preferred to employ arc silica and silicon monoxide. Methods for making the various modifiers are disclosed in the succeeding paragraphs.

Arc silica is made by heating silica or a silica-furnishing material with a carbonaceous material at high temperature in a reducing atmosphere and rapidly condensing the product in air. It is essentially spherical, amorphous and has a surface area of about 50–300 $M^2/g$ (meters square per gram) and a particle size of about 5–100mu. (millimicrons). A method for making arc silica is disclosed in copending patent application of Arthur E. Van Antwerp, Ser. No. 465,370, filed Oct. 28, 1954, and entitled "Method and Apparatus for Conducting Chemical Reactions", and now U.S. Pat. No. 2,863,738. Still other methods of making arc silica are known such as those disclosed in the U.S. Pat. to Potter Nos. 875,674 and 886,637. Moreover, in place of an arc furnace a resistance furnace can be employed to produce an amorphous finely-divided "arc" silica as shown in the U.S. Pat. to Porter No. 2,573,057 dated Oct. 30, 1951.

Fume silica may be produced by decomposing or burning, with or without a combustible gas, a material such as ethyl silicate, silicon tetrachloride and the like. It is spherical in shape, has a surface area of about 80–200 $M^2/g$ and a particle size of about 5–200 mu.

"Silicon monoxide", which is really a disproportionation product of silicon and silicon dioxide, having the now generally recognized formula, $(Si)_x.(SiO_2)_y$ where x and y are integers, is made in a manner similar to that of arc silica except that the gases produced during the reaction are introduced rapidly into a vacuum chamber and rapidly cooled or condensed. This product called "Monox" is described in the following U.S. Pat. Nos. 875,286 (Potter); 875,675 (Potter); 993,913 (Tone); 1,104,384 (Potter), and in "Transactions of the American Electrochemical Society", Vol. XII, 1907, pages 191–228 (Potter). When viewed under the electron microscope particles of the Potter "Monox" comprise a mixture of substantially fibrous particles and the balance spherical and/or horn-like particles. The fibers have a ratio of width to length of from about 1:10 to 1:50 and exhibit a surface area of 60 to 200 square meters per gram. Their average length will vary from about 50 to 600 millimicrons. The spherical or horn-like particles in a mixture have an average particle size of from 5 to 200 mu. and a surface area of about 200–300 $M^2/g$. A method for increasing the amount of fibers by condensing the silicon monoxide gas under essentially nonturbulent conditions in an atmosphere of a pure inert gas is disclosed in copending application of Daniel S. Sears, Ser. No. 433,020, entitled "Method of Making Pigment" and filed May 28, 1954, and now U.S. Pat. 2,823,979. A new fibrous "Monox" containing nitrogen and a method for its production are set forth in copending application Ser. No. 433,099, of Daniel S. Sears, entitled "Pigment and Process of Making the Same" filed May 28, 1954, and now U.S. Pat. 2,823,980. A method for obtaining silicon monoxide substantially spherical or essentially spherical in shape having a particle size of about 5–200 mu. and a surface area of 200–300 $M^2/g$ is set forth in copending application of Edwin B. Newton and Daniel S. Sears, Ser. No. 433,291 entitled "Reinforcement of Rubber" and filed May 28, 1954, and now U.S. Pat. 2,807,600. Both the Potter "Monox" and the "Monox" of the above applications are brown in color, and if it is desired to use a white or colorless material, these "Monoxes" must be heated in an oxidizing atmosphere to a high temperature but below the sintering point of the pigment for several hours as shown in copending application of Edwin B. Newton and Daniel S. Sears, Ser. No. 433,289, entitled "Improving Color of Pigments" filed May 28, 1954, and now U.S. Pat. 2,894,929, to provide a product which is completely white. This is evidenced by the fact that when introduced into benzene, it disappears completely from sight indicating that it has virtually the same index of refraction as the benzene. On the other hand, Potter in his U.S. Pat. Nos. 875,674, 886,637 and 908,131 suggests that a white product may be made by blowing his "Monox" and air through a heated tube or through an oxidizing flame. Although this product appears white on the surface it is apparently not changed in color in the interior of the particles for when introduced into a body of benzene, the benzene immediately becomes brown in color. Moreover, when used in rubbery compositions, the so-called white product of the prior art will not produce white rubbery goods. Apparently, the process of the patents produces only a surface coating of oxide on the particle(s) or incompletely oxidizes the particle(s). It, however, is to be understood that in the specification and claims, silicon monoxide is intended to mean fibrous or spherical silicon monoxide, or mixtures thereof, whether brown, white or partially white unless otherwise defined.

Silicon oxyimide or polymeric silicon oxyimide, $(SiONH)_x$ where x is an integer, is also produced in an arc furnace but the gaseous products evolved during the reaction are rapidly introduced into a reaction chamber having an atmosphere of ammonia gas and which is substantially free of oxygen. The resulting particles are essentially spherical in shape and have a particle size of about 5 to 200 millimicrons. The process of producing such a compound is fully disclosed in application of Daniel S. Sears, Ser. No. 164,619, filed May 26, 1950, and entitled "Reaction Product of Silicon Monoxide and Ammonia and Rubber Compositions Containing the Same", now U.S. Pat. No. 2,666,754, dated Jan. 19, 1954.

Mixtures of the above oxygen-silicon containing compounds can be employed if desired although generally in the practice of the present invention it is preferred to use only one compound.

The burning rate modifier is used in a minor amount sufficient to obtain increased linear burning rates at elevated gas pressures and all conditions of ambient temperature. Minor amounts as low as 0.1% by weight will show improvement in the linear burning rate. However, in general, at least about 0.5% by weight of the modifier is preferably used in the composition the balance being the oxidizing agent and the rubbery, plastic polymeric binder except for the usual compounding aids and the like. While much larger amounts can be used, it is preferable not to go over about 5% by weight as no marked improvement in burning rates or burning under gas pressure is observed and, further, larger amounts of oxidizer may tend to decrease the amount of useful gaseous products produced and the physical properties of the resulting product by reducing the amount of the oxidizing agent and/or the organic binder.

THE OXIDIZING AGENT

The oxidizing agent used in the composition of the present invention is ammonium perchlorate which readily decomposes on ignition to liberate gases which contain excess oxygen in the form of $O_2$ or in some other form which is available for combusting the organic, plastic, rubbery binder. It is used because it decomposes entirely into gaseous products or into predominantly gaseous products and only minute amounts of finely-divided solid or liquid particles and its chemical constitution is such that for a given weight of said agent the molecular weights of the gases produced on decomposition are low in relation to the mols of available oxygen produced. It is relatively stable at temperatures of from about −65°to +175°F. so that it does not decompose in the composition nor melt to distort the composition when cured and is readily processable so that it can be compounded with the modifier and binder into a gas-generating composition.

The amount of oxidizing agent employed in the composition should be sufficient to furnish enough oxygen to burn the binder and produce a large volume of gas in a short period of time. The oxidizing agent should burn or oxidize the binder preferably entirely to $H_2O$ and CO and even more preferably to $H_2O$ and $CO_2$ and Cl or N gaseous compounds when the binder contains Cl or N radicals, etc. while producing large volumes of the same or other gases to obtain the greatest pressures. Hence, the amount of oxidizing agent is chosen so that a large volume of gas will be produced including oxygen in a form and amount sufficient to combust the binder. On the other hand, the binder is used in an amount deemed necessary to provide the composition with the requisite processability and physical properties. In general, therefore, the ammonium perchlorate will be present in a major amount and the binder will be present in a minor amount. Preferred compositions prepared according to the teachings of the present invention contain from about 70 to 87% by weight of the oxidizing agent the balance being the burning rate modifier and the binder except for the usual compounding ingredients. It will, of course, be apparent that, where lower burning rates are desired or where unreacted particles from the binder are not objectionable, larger amounts of binder can be used which will accordingly afford even better physical properties to the composition herein disclosed.

The ammonium perchlorate should be dried or essentially dry before compounding with the modifier and the binder to obtain the highest burning rates in the resultant composition. In some instances it should be ground before incorporation into the organic binder whereas in other instances it need only be in granular form since the shearing action developed during milling and mixing will reduce its size so that burning rates are enhanced. In any event in the resulting composition the perchlorate should be in finely-divided form whether added as such initially or produced in such condition during processing.

THE PLASTIC RUBBERY BINDER

The plastic, rubbery polymeric material employed as a binder in the composition of the present invention should be an elastomer which is strong, elastic, flexible and tough after curing or fusing and which adheres to itself and to the oxidizing material. The polymer, also, should readily be combustible to form gaseous products such as CO, $H_2O$ and $CO_2$ and also N and Cl containing gases where such elements or their radicals form a part of the polymer and preferably should contain some unsaturation or a number of double bonds or some easily oxidizable linkages after curing to increase the rate of decomposition and/or combustion, and, accordingly, a polymer which cures through means other than a double bond should preferably be used. Moreover, the polymer should be sufficiently plastic to be extruded, mixed, molded, and otherwise processable at room temperatures or at temperatures appreciably below the autoignition temperature of the composition and also be highly loadable. By "temperatures appreciably below the autoignition point of the composition" is meant temperatures at which mixing, milling, molding and curing or fusing can be performed without spontaneous ignition of the composition. Preferably, the processing and curing or fusing of the polymer with the modifying agent and the oxidizing agent is performed safely at temperatures of about 100° F. less than the autoignition point of the composition which depends on the types and amounts of components of the composition. Binders which are rubbery and plastic and which have been found useful in the practice of the present invention are polyesterurethanes, polymers containing curable acid groups, plasticized haloethylene containing polymers and sulfur curable polymers. Still other rubbery plastic binders can be employed. Of the various polymers that can be used, it is preferred to employ the polesterurethanes and the combined curable acid group containing polymers which can be processed at relatively low temperatures and readily decompose or burn. It will be appreciated that the various polymers contemplated will provide some variation in the chemical and physical properties of the composition and that certain polymers may be best for certain specific end uses. Moreover where mixing on mills or other devices occurs it is desirable to use polymers having higher viscosities due to the increase in linear burning rate realized probably due to the shearing action occurring between the polymer and other ingredients on the mill during mixing. Methods of making the plastic, rubbery, polymeric binders and methods for mixing them with the burning rate modifier and the ammonium perchlorate are set forth in detail in the following paragraphs.

A. THE POLYESTERURETHANE BINDER

The polyesterurethane binders are formed by the reaction of an organic diisocyanate compound with a hydroxyl containing polyester reaction product of a dibasic acid and a glycol and cross-linked, cured or vulcanized by means of a polyfunctional hydroxyl or polyhydroxy curing agent.

A method for making the polymeric binder and the types of reactants which can be employed will be described in the following paragraphs. Still other methods can be used.

The polyester is prepared by an esterification condensation reaction of a dibasic (dicarboxylic) acid or an anhydride thereof with a glycol. To obtain a terminal hydroxyl group a molar excess of the glycol is employed. Molar excesses of acid are to be avoided since they would form terminal carboxyl groups which are not desired as they generally cause gas release during the subsequent cross-linking reaction.

The dicarboxylic acids used in the esterification reaction include adipic, azelaic, glutaric, maleic, malonic, pimelic, sebacic, suberic, succinic, and the like of which adipic acid because of cost and availability is preferred. It is not essential that the acid be used for similar results can be obtained with the corresponding acid anhydride or acid chloride. Dicarboxylic acids containing a nitro group may also be used such as nitro adipic acid, nitro suberic acid, and the like, to oxygen-enrich the polymer. Alicyclic dicarboxylic acids can be used as well as the aliphatic dicarboxylic acids which are preferred. Moreover, mixtures of the acid, anhydride or chloride can be employed.

The glycols utilized in the preparation of the polyester are ethylene glycol, 1,3-butanediol, 1,4-butanediol, pentamethylene glycol, hexamethylene glycol, cyclohexanediol, diethylene glycol, triethylene glycol, 1,2-propanediol, 1,3-propanediol, and 1,2-butanediol, etc. Ethylene glycol is the preferred glycol to employ. Moreover, glycols containing a nitro group such as 2-nitro hexanediol-1,6, 2-nitro octanediol-1,8, and the like, to oxygen-enrich the polymer can be used. Likewise, mixtures of glycols can be employed in the esterification reaction.

To prepare the polyester, the dibasic acid and glycol are reacted together at elevated temperature and reduced pressure to remove substantially all of the water of esterification and excess reactants. Polyesters of average molecular weights of 600 to 3,000 can easily be obtained. It is preferable to store the resulting polyester under anhydrous conditions until used in subsequent operations to avoid the formation of gas bubbles in the subject composition.

Organic diisocyanates which are usefully reacted with the polyester are aromatic diisocyanates such as meta-tolylene diisocyanate, naphthylene-1,5-diisocyanate, diphenylmethane-p,p'-diisocyanate, triphenylmethane-p,p'-diisocyanate, and the like. Aliphatic diisocyanates such as hexamethylene diisocyanate and the like can also be employed. Phenylene diisocyanates such as p-phenylene or m-phenylene diisocyanate, 4,4'-diisocyanato dibenzyl and other phenylene diisocyanates can also be employed. The diisocyanate can also contain an oxygen-enriching nitro group. Examples of such a compound are 2-nitro-p-phenylene diisocyanate, 5-nitro-m-phenylene diisocyanate and others. Mixtures of the organic diisacyanates can also be used.

The diisocyanate is used in a molar amount greater than, equivalent to or slightly less than the total combined mols of the polyester and of the cross-linking agent. It is to be understood that the cross-linking agent is employed in an amount sufficient to obtain a plastic, rubbery tough polymeric gum stock when uncompounded or unloaded with the oxidizing agent and modifier. Preferably, the amount of diisocyanate will vary from about 1.3 to 2.0 mols per mol of polyester and per 0.2 to 0.8 mol of polyhydroxy cross-linking agent. These amounts, of course, can be varied somewhat to obtain more or less resilient gum stocks.

In preparing the binder the hydroxyl terminated polyester is melted and degassed at reduced pressure and at elevated temperature. The organic diisocyanate is then reacted with the molten polyester with agitation under vacuum at elevated temperature for a short time to provide a liquid polyester polyurethane. The product, cooled to room temperature, is then compounded as a liquid in a mixer with the burning rate modifier, the oxidizing agent, and other additives including the cross-linking agent.

The use of cross-linking agents with the polyester-diisocyanate reaction product or polyesterurethane is desirable to prevent crystallization to a brittle material or to prevent tackiness or flowing of the composition when warmed and to permit handling although the polyesterurethane will cure by itself in moist air after an extended period of time. Cross-linking agents are polyfunctional hydroxyl compounds such as ethylene glycol, 1,2-butanediol, 1,3-butanediol, 1,4-butanediol, hexamethylene glycol, pentamethylene glycol, cyclohexanediol, diethylene glycol, triethylene glycol, 1,2-propanediol, 1,3-propanediol, trishydroxy methyl nitromethane, and the like. Polyesters of the types hereinbefore mentioned can likewise be used. Triols such as glycerol, 1,1,1-trimethylol propane, trimethylol hexane, monoesters of pentaerthritol and the like are also useful curing agents and are desirable to use when a fast cure is needed. Mixtures of diols and triols can also be used and result in cured binders having a good balance of physical properties. Low molecular weight polyesters with terminal hydroxyl groups prepared from a dibasic acid, glycol and a triol are particularly useful. Other polyfunctional hydroxyl compounds such as ethanolamine, diethanolamine and the like are also effective curing agents. While ethanolamine may cause gelation of the mixture it can be employed in small amounts or it can be employed with gylcerol or ethylene glycol to effect a tight rapid cure. Of the various curing agents that can be employed the aliphatic glycols are preferred since they permit easier handling before curing. While the actual curing mechanism of the polyesterurethane, the polyester-organic diisocyanate reaction product, is not precisely known, it would appear that the polyfunctional hydroxyl compound is necessary to obtain plastic, rubbery, tough cures or vulcanizates of the polyesterurethane, and accordingly, for the purposes of this invention it will be termed a cross-linking, curing or vulcanizing agent.

In preparing the gas-generating composition the polyester and the diisocyanate are reacted under vacuum at an elevated temperature with agitation to produce the polyesterurethane. The material is cooled, preferably to room temperature, and mixed with the required amount of the burning rate modifier and the finely-divided oxidizing agent in a mixer such as a Baker-Perkins Sigma-blade mixer and preferably under reduced pressure. The use of a vacuum is preferred since it avoids the possibility of the formation of gas bubbles in the finished product. Mixing is conducted sufficiently long to thoroughly disperse the burning rate modifier and the oxidizing agent throughout the binder. After the polyesterurethane, burning rate modifier and oxidizing agent have been thoroughly mixed together, the cross-linking agent is added, mixing being continued under vacuum with cooling of the apparatus.

The mixed composition can be removed and sheeted out, extruded, or pressed into the desired shapes for cure. Curing is preferably conducted at temperatures not above about 170° F. for a short period of time while the material is pressed or in a mold to speed production. However, curing can be effected at room temperature in the air after molding but longer times will be required. A feature of the use of polyesterurethanes is that mixing, molding and curing can be accomplished at relatively low temperatures, i.e. not over about 100° F. for mixing and not over about 170° F. for curing, well below the autoignition point of the composition, with obtainment of good physical and chemical properties and under conditions of relative safety. Cures can be effected in 30 mins. at 165° F. and even at room temperature although longer times, about 16 hours, may be required. Another important point is that no noticable exothermic heat of reaction occurs during the cure. While mixing is conducted preferably at pressures below atmospheric, it is apparent that mixing can be conducted under atmospheric or higher pressure and some or all of the entrapped gas bubbles that result may be eliminated by molding at high pressures or by subjecting the mixed uncured composition to a degassing step prior to curing or by a combination of the above. Alternatively, if gas bubbles are not objectionable, mixing in air and degassing need not be conducted. Likewise while the curing agent can conceivably be added at the same time the modifier and the oxidizing agent are mixed with the polyesterurethane, it is preferred to add it last to minimize the extent of curing of the polymer within the mixing apparatus itself. It, of course, is apparent that mixing times and temperatures will vary somewhat depending on the particular materials, their amounts, the type of mixing apparatus used, etc. For example, some rubbery polyesterurethane containing compositions can be used on a conventional rubber mill. Likewise, pressures and temperatures for molding and extruding will vary. Curing times will be somewhat dependent on the size of the article cured.

While the preferred order of operations in preparing the composition has been described above, it is apparent that other techniques or apparatus can be employed. Oxygen-rich organic plasticizers such as tetranitromethane, nitroglycerine and the like may also be incorporated into the mixture, in minor amounts, preferably prior to adding the cross-linking agent to reduce the viscosity of the mixture. An organic retarder such as ethyl cyano acetate (about 0.1% by weight of the polyesterurethane) can be added to the polyesterurethane reaction mass to delay cross linking when the cross-linking agent is mixed with a large mass of the polyesterurethane oxidizing agent and burning rate modifier. Tartaric acid which functions as a curing agent but is slower than the triols may also be used as a retarder. On the other hand the composition may be made faster curing by inclusion of a minor amount of a promoter such as a soluble cobalt salt, i.e., cobalt naphthenate, cobalt octoate, cobalt acetyl acetonate, etc.

B. THE CURABLE ACID GROUP CONTAINING POLYMERIC BINDER

The curable acid group containing polymeric binders are also rubbery and plastic and comprise predominantly linear carbon chains containing combined curable acid groups such as COOH, $SO_3H$, $SO_2H$, $PO_3H_2$ or other acid group on the chain which will crosslink, cure or vulcanize, preferably by means of a metal oxide, at relatively low temperatures. Polymers having groups such as COOR, COCl, CN, $CONH_2$ $COONH_4$, COOMe where Me is a metal and the like and which are convertible to COOH groups by ammonolysis, hydrolysis or similar reaction, for example, by treating such polymers with dilute mineral acids, HCl or $H_2SO_4$, or concentrated or, preferably, dilute KOH or NaOH can also be employed after such groups have been converted to a curable COOH group. Derivatives of $SO_3H$, $SO_2H$, $PO_3H_2$ or other acid groups convertible by hydrolysis to the free acid groups may also be similarly employed. Examples of the types of polymers contemplated are copolymers formed by the copolymerization of a major amount of an open-chain aliphatic conjugated diene and an olefinically unsaturated carboxylic acid, by the reaction of a polymer of a diene with a carboxyl supplying reagent preferably in the presence of a catalyst, by copolymerization of a diene with an olefinically unsaturated copolymerizable compound hydrolyzable to form an acid group, by copolymerization of alkyl ester of an acrylic type acid with an olefinically unsaturated carboxylic acid, by hydrolysis of an alkyl ester of acryclic acid or by copolymerization of a major amount of a monoolefin or isoolefin with a copolymerizable compound hydrolyzable to form groups containing bound —COOH. Still other polymers can be employed such as those formed by the copolymerization of dienes with alkyl acrylates, by the polymerization of alkyl acrylates alone and by the polymerization of an alkyl acrylate with at least one other olefinically unsaturated monomer which then are hydrolyzed to obtain curable —COOH groups.

Dienes which are copolymerizable with an olefinic unsaturated carboxylic acid can be a butadiene hydrocarbon such as butadiene-1,3, 2-methyl butadiene-1,3, 2,3-dimethyl butadiene-1,3, 2-neopentyl butadiene-1,3 and other hydrocarbon homologs of butadiene-1,3 as well as other substituted open-chain aliphatic conjugated dienes such as 2-chloro butadiene-1,3, 2-cyano butadiene-1,3. Straight chain conjugated pentadienes and straight- and branch-chain conjugated hexadienes may also be used. Of the dienes, butadiene-1,3 is preferred due to its availability and ease of handling. Carboxylic acids which are copolymerized with the dienes may possess one or more olefinic carbon-to-carbon double bonds and one or more carboxyl (—COOH) groups such as mono-carboxy and polycarboxy monoolefinic and poly-olefinic carboxylic acids of which the acids having the olefinic double bond present in the monomer molecule in the alpha-beta position with respect to the carboxyl group or attached to a terminal methylene group are preferred. Citraconic, mesaconic and itaconic acids are illustrative of polycarboxylic monoolefinic comonomers which can be used. Some examples of alphabeta unsaturated carboxylic acids are cinnamic acid, crotonic acid, dehydrogeranic acid, fumaric acid, glutaconic acid, maleic acid, muconic acid, sorbic acid, alpha chloro sorbic acid, umbellic acid, beta- (2-butenyl) acrylic acid, 2,4-pentadienoic acid, alpha isopropenyl furfural acetic acid, 3-carboxy-pentadiene-(2,4)-oic-1. Some examples of acids containing terminal methylene groupings are acrylic acid, acryloxy propionic acid, alphachloro acrylic acid, alpha bromo acrylic acid, methacrylic acid, ethacrylic acid, beta vinyl acrylic acid, betaacryloxy acetic acid, vinyl acetic acid, undecylenic acid and others. Of the various olefinically unsaturated carboxylic acids, it is much preferred to employ acrylic acid, methacrylic acid, ethacrylic acid; etc., and especially sorbic acid, since they contain an olefinic double bond in alpha-beta position to the carboxyl group and also contain a terminal methylene group.

The open chain aliphatic conjugated diene monomer can be coor interpolymerized in amounts of at least 50% by weight, preferably at least 80% by weight, with the balance essentially the olefinically unsaturated carboxylic acid monomer in acid aqueous medium as disclosed in U.S. Pat. application of Harold P. Brown, Ser. No. 193,521, filed Nov. 1, 1950 , now U.S. Pat. No. 2,724,707.

Terpolymers formed of butadiene-1,3, methacrylic acid and acrylonitrile or styrene can also be used.

The reaction of a diene polymer with a carboxyl supplying reagent or with a carboxylating agent to obtain a rubbery carboxyl containing polymer of an open-chain aliphatic conjugated diene may be obtained by reacting acrylic acid, maleic acid or anhydride, thioglycollic acid, beta-mercapto propionic acid, and the like with a plastic rubbery polymer of a diene such as butadiene-1,3 or any of the open-chain aliphatic conjugated dienes mentioned above which do not contain combined carboxyl groups preferably in the presence of a peroxygen catalyst. Methods for obtaining such polymers are shown in U.S. Pat. to Harold P. Brown, No. 2,662,874, dated Dec. 15, 1953. Moreover, natural rubber or any of the naturally occurring rubbery polymers of the open-chain aliphatic conjugated diene type can likewise be treated with a carboxyl supplying reagent to introduce carboxyl groups into the natural rubber polymer.

The copolymerization of a diene with a copolymerizable olefinically unsaturated compound hydrolyzable to produce a rubbery polymer containing —COOH groups can be effected by co- or interpolymerizing one of the foregoing open-chain aliphatic conjugated diene monomers with a monomer such as acrylamide, acrylonitrile, alkyl acrylate, alkyl alkacrylate, and the like and hydrolyzing the resulting polymer with a hydrolyzing agent as disclosed in U.S. patent application of Harold P. Brown, Ser. No. 193,523, filed Nov. 1, 1950, now U.S. Pat. No. 2,710,292.

Plastic rubbery materials formed by the copolymerization of alkyl esters of acrylic acid in an acidic medium with an olefinically unsaturated carboxylic acid as described above or by the hydrolysis of plastic polymers of alkyl esters of acrylic acid are described in U.S. patent application of Earl J. Carlson, Ser. No. 197,524, filed Nov. 24, 1950, now U.S. Pat. No.2,726,230, and in U.S. Pat. to Harold P. Brown, No. 2,649,439, of Aug. 18, 1953.

Isoolefins such as isobutylene are polymerizable with a minor amount of a copolymerizable acid monomer such as acrylyl chloride. The resulting polymer can then be treated to hydrolyze the acid chloride groups to carboxyl groups. These polymers are also plastic and rubbery and methods for making the same are disclosed in U.S. application of Harold P. Brown, Ser. No. 197,497, filed Nov. 24, 1950, now U.S. Pat. No. 2,671,074.

Rubbery, plastic homopolymers and copolymers of low molecular weight alkyl acrylates such as homopolymers formed by polymerizing monomeric ethyl acrylate, butyl acrylate, octyl acrylate and others to form polyethyl acrylate, polybutyl acrylate, polyoctyl acrylate and the like as well as the co- or interpolymers of two or more of these alkyl acrylic acid esters, such as the copolymer of ethyl acrylate and butyl acrylate can be hydrolyzed to obtain COOH groups and are also useful as pointed out above. Polymers of alkyl alkacrylates and copolymers of alkyl alkacrylates and alkyl acrylates can also be hydrolyzed and used in practice of the present invention. Moreover, a major amount of at least one of the alkyl acrylic acid esters can be copolymerized with a minor amount, preferably not over 20% by weight, of at least one other copolymerizable monoolefinic monomer such as acrylonitrile, methacrylonitrile, vinyl chloride, vinylidene chloride, dichloro difluoro ethylene, beta chloroethyl vinyl ether, styrene, alpha monochloro styrene, alpha methyl styrene, dichlorophenyl ethylene, vinyl triethoxy silane, normal butyl vinyl ether, N-vinyl-2-pyrrolidone, N-tertiary butyl acrylamide, beta hydroxy propyl acrylate, vinyl butyl cellosolve, 2-ethoxy ethyl acrylate and the like. The polymers are formed by polymerization of the monomer or monomers in a large volume of water containing potassium persulfate, sodium pyrophosphate, and a dispersing or wetting agent with agitation at temperatures of about 50° C. After formation they can be hydrolyzed to obtain COOH groups and then cured by means of a metal oxide or other suitable curing agent.

Still other plastic rubbery polymers can be used. For example, the butadiene-carboxylic acid, and the butadiene-alkyl acrylate or alkyl alkacrylate monomer systems can contain one or more monomers copolymerizable therewith such as acrylonitrile, styrene, and the like. The diene polymer which is reacted with a carboxyl supplying reagent in the presence of a catalyst can also be a polymer formed by copolymerizing the diene with acrylonitrile, styrene, vinyl pyridine, etc. Hydrolyzable polymers formed by the copolymerization of a diene and a nitrile such as acrylonitrile can contain at least one other monomer such as styrene, vinyl pyridine, and others and can then be hydrolyzed with a hydrolyzing agent as disclosed above.

Moreover, the butadiene-alkyl acrylate or alkyl alkacrylate polymers, the polyalkyl acrylates, or the copolymers of alkyl acrylates and monomers such as acrylonitrile, vinyl chloride and the like may contain a minor amount of acrylic acid, methacrylic acid, sorbic acid, etc. In the diene-carboxylic acid polymers there can be used in place of or in addition to the carboxylic acid monomer, a monomer such as beta acryloxy acrylic acid to provide a plasticizing action. Another monomer which is copolymerizable with the diene and carboxylic acid and which will provide a side chain affording plasticizing action will be a quarternary ammonium salt such as vinyl ethyl ether trimethyl ammonium chloride, $CH_2{=}CHO(CH_2)_2N(CH_3)_3Cl$. It will be understood that plasticizing action is also obtained where the diene carboxylic acid polymer contains another monomer such as an acrylate to provide an ester side chain or where the carboxylic acid, polymerized with the diene, itself contains an ester group. An example of such polymer is one formed by the copolymerization of butadiene-1,3, beta acetoxy ethyl acrylate and acrylic acid.

Other polymers which will be found useful in practice of the present invention are polymers obtained by the reduction of a butadiene-1,3-acrylonitrile copolymer (55/45) to form a polyamine ($Rx\text{-}CN \rightarrow Rx\text{-}CH_2NH_2$) by treatment with a hydride in a solvent (lithium aluminum hydride in tetra hydro furane). This polymer or a butadiene vinyl pyridine copolymer can be admixed with a butadiene-carboxylic acid copolymer. Such mixtures are self-vulcanizing. Polymers can also be obtained by hydrolyzing a butadiene/vinyl pyridine/acrylonitrile polymer. Such polymers will form salt linkages on curing and some will cure without the need of any specially added curing agent. Another polymer suitable for self-vulcanization or cross-linking is a butadiene copolymer with

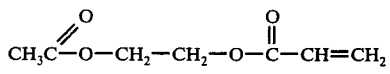

and $CH_2{=}CHCOOH$ which by ester interchange will cross link through the elimination of acetic acid to give: Polymer

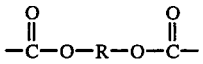

Polymer linkages.

To introduce $SO_3H$, $SO_2H$ and $PO_3H_2$ groups analogous monomers to those employed for introducing COOH groups may be employed. Preferred monomers include vinyl sulfonic acid, vinyl sulfinic acid, vinyl phosphonic acid and butadiene phosphonic acid. Examples thereof are copolymers of from 85–90 parts by weight of butadiene-1,3 and the balance vinyl sulfonic or sulfinic acid.

It will be understood that the foregoing polymer systems are not limited to two or three monomers but that tetra, and higher polymers may be formed by polymerizing 4,5 or more monomers together. Polymers formed by polymerizing one or more of the monomer systems mentioned above in the presence of at least one previously polymerized homo-, co-, inter-, and the like polymer of at least one of the foregoing monomer systems can likewise be used. Moreover, blends of the various combined curable acid group containing polymers, copolymers, interpolymers and the like may be formed by blending the polymers in the form of latex followed by subsequent co-coagulation, by blending or mixing on a rubber mill or by blending or mixing in a Banbury. In some instances the mills must be cooled and/or the mixing action slowed to avoid premature curing.

Curing agents for the acid group containing polymers can be any of the useful metallic oxides such as zinc oxide, calcium oxide, cadmium oxide, magnesium oxide, lead oxide, and the like as well as metallic hydroxides such as calcium hydroxide, cadmium hydroxide, and others. Still other curing agents can be employed such as diamines (hexamethylene diamine), polyamines, and the like. On the other hand, polymers such as the polymer of butadiene-1,3/vinyl pyridine/acrylic acid can be cured by heat alone. Mixtures of polymers which react together under the influence of heat alone to also form salt linkages such as the polymer formed by the reaction of a heated mixture of a copolymer of butadiene-1,3 and acrylic acid with a copolymer of butadiene-1,3 and vinyl pyridine can also be used. Amide linkages can also be formed with suitable polymers such as a copolymer of allyl amine and methacrylic acid.

The curing agent, when used, will be employed in a minor amount sufficient to form a plastic rubbery polymer when the oxidizing agent is not present. In general only very minor amounts are desired to obtain the best physical properties of the composition especially as to tensile strength and elongation. It is not desired to obtain a hard cure of the rubber, for example, to obtain a material having the properties of ebonite but rather to obtain a flexible, rubbery, tough and plastic material as is produced on a soft cure. While the amount of curing agent may vary considerably, it has been found best to use it in amounts of from about $\frac{1}{2}$ to 5 parts by weight per 100 parts of rubbery polymer although more or less can be used depending on the particular polymer and curing agent used.

While sulfur can be employed to cure the diene-containing or other unsaturated polymers disclosed above in order to provide cross linking on curing between the unsaturated carbon atoms in such polymers, sulfur cures are not usually desirable since the times and temperatures required for curing are somewhat long or hazardous. For example, where one of the above polymers of a given size will cure in about 1 hour at 165° F. when curing through the acid group, it will require from 24 to 72 hours to cure with sulfur. Obviously, such saving in time is a great advantage in production. Moreover, to use higher temperatures, 270°–310° F., normally required for sulfur cures in order to decrease the time of cure, is dangerous since such temperatures approach the autoignition point of the composition where it may burn or explode. Another feature of curing through the acid group is that curing may even be accomplished at room temperature well below the autoignition point of the composition although longer times may be required. On the other hand a sulfur cure at room temperature will require an appreciable amount of accelerator which is not available for increasing the strength of the resulting composition and which must be compensated for on combustion by the addition of more oxidizing agent. Yet another very important reason for the avoidance of sulfur cures is that sulfur reduces the number of double bonds of the dienes or polyolefinic materials so as to render them less readily combustible. The presence of unsaturation in the cured polymer is highly desirable to afford a material which will readily and rapidly decompose or oxidize when ignited or which is thermally unstable at high temperatures.

Additional compounding ingredients may be added to the composition such as antioxidants, softeners or plasticizers, which are to be desired, and the like. Examples of useful antioxidants are the reaction product of acetone and diphenyl amine, hydroquinone monobenzyl ether, p,p'ditertiary octyl diphenyl amine, aldol alpha naphthylamine, polymerized trimethyl dihydro quinoline and others. Only very minor amounts of the antioxidant need be present.

Examples of useful softeners are stearic acid, palm oil, pine tar, oleic acid, etc. An unsaturated softening agent such as oleic acid permits easier and faster mill mixing, permits extruding or molding at lower temperatures and pressures, and is less suppressive on the burning rate of the composition due to the presence of an olefinic double bond. Still other softeners can be used such as natural rubber, rubbery butadiene-styrene copolymers, rubbery polymers of alkyl acrylates, rubbery copolymers of alkyl acrylates and alkyl alkacrylates, rubbery butadiene-alkyl acrylate or acrylonitrile copolymers, etc. Mixtures of petroleum oils and asphalt can also be employed and have proved very satisfactory. The softener may be used in amounts up to about 33% by weight of the rubber. It will be understood that an additional amount of curing agent will be needed in the composition to compensate for the acid group in the acid softeners when acid softening agents are used. Other ingredients such as acid retarders disclosed in U.S. Pat. to Harold P. Brown, No. 2,669,550, dated Feb. 16, 1954, may also be employed with the composition of the present invention. While a portion of the acid softening agent of the present composition is probably functioning as a retarder, the bulk of this material is providing the desired softening action. In place of using retarders the amount of curing agent can be reduced.

In preparing a gas-generating composition using a combined curable acid group containing polymer, the burning rate modifier, the oxidizing agent, polymer and, preferably, the softener too are mixed on the cooled rolls of a rubber mill which are revolved at a relatively low speed so that the temperature of the mixture does not exceed about 170° F. While the oxidizing agent preferably should be dried prior to use if not already dry to obtain the highest burning rates and while it should be in granulated form rather than in chunks to reduce the time of mixing, it need not be sized nor specially ground prior to mixing since the shearing forces developed during mixing with the polymer reduce the particles to the required size. Mill mixing is much preferred, especially beyond the final addition of the oxidizing agent, since it provides an unexpected increase in strand burning rates. After the burning rate modifier, the oxidizing agent, polymer and softener have been thoroughly mixed together, the curing agent is added to the mixture on the rolls of the mill, mixing continued for a short time before appreciable curing has occurred, and the curable composition then molded or extruded and cured at temperatures appreciably below the autoignition point of the composition and preferably at least about 100° F. below the autoignition point of the composition. In general, curing temperatures will vary from about room temperature up to about 212° F. with curing time dependent on the temperature used and thickness of the section being prepared. Curing also, is preferably conducted while the composition is molded. More or less curing will occur depending on the heat involved during molding or extruding. Forming and curing times will vary according to the size of the object, the temperature and pressure.

Mixing of the burning rate modifier and oxidizing agent with an aqueous dispersion of the polymer or with a solution of the polymer in a volatile organic solvent may also be used as a means to secure blending of the burning rate modifier, the oxidizing agent and the polymeric binder. However, such procedure is not generally desirable since the dispersing medium or solvent must be removed by filtering or evaporation and in the case of dispersions excess oxidizing agent must be employed to compensate for that in solution. Moreover, although the resulting material may be pressed into the desired shape, it is not as dense as the milled and pressed mixtures and the oxidizing agent and polymer have not been subjected to the shearing forces occurring during milling which provide improved physical and chemical properties. To obtain such properties, thus, it is still necessary to undertake some milling.

C. OTHER POLYMER BINDERS

The haloethylene containing polymers may be used and include all of the haloethylene polymers composed predominately of a polymerized haloethylene having from one to two halogen atoms attached to only one of the carbon atoms, such as homopolymers of vinyl chloride, vinyl bromide, vinyl fluoride, vinylidene chloride, vinylidene bromide, or vinylidene fluoride and interpolymers or copolymers of two or more of these monomers. Copolymers or interpolymers made from monomeric mixtures containing at least one haloethylene monomer together with a lesser amount of one or more copolymerizable monoolefinic monomers can also be employed. Monoolefinic materials which can be co- or interpolymerized with the haloethylene monomers include vinyl esters such as vinyl acetate, vinyl benzoate, vinyl butyrate, vinyl chloroacetate, vinyl chlorobenzoate, vinyl propionate, vinyl chloropropionate, and others; acrylic and alpha-alkyl acrylic acids, their alkyl esters, their amides and their nitriles such as acrylic acid, chloroacrylic acid, methacrylic acid, ethacrylic acid, methyl acrylate, ethyl acrylate, butyl acrylate, n-octyl acrylate, 2-ethylhexyl acrylate, n-decyl acrylate, methyl methacrylate, butyl methacrylate, methyl ethacrylate, ethyl ethacrylate, acrylamide, N-methyl acrylamide, N,N-dimethyl acrylamide, methacrylamide, N-methyl methacrylamide, N,N-dimethyl methacrylamide, acrylonitrile, chloroacrylonitrile, methacrylonitrile, ethacrylonitrile, and the like; vinyl aromatic compounds such as styrene, dichlorostyrene, vinyl naphthalene and others; alkyl esters of fumaric and maleic acids such as dimethyl maleate, diethyl maleate, and others; vinyl alkyl ethers and ketones such as vinyl methyl ether, vinyl ethyl ether, vinyl isobutyl ether, 2-chloro-ethyl vinyl ether, methyl vinyl ketone, ethyl vinyl ketone, isobutyl vinyl ketone, etc.; and in addition other monoolefinic materials such as vinyl pyridine, N-vinyl carbazole, N-vinyl pyrrolidone, ethyl methylene malonate, isobutylene, ethylene, trichloroethylene, and various other readily polymerizable compounds containing a single olefinic double bond, especially those containing the $CH_2{=}C<$ group. When utilizing interpolymers or copolymers, the proportions of the various monomers in the monomeric mixtures polymerized to give the interpolymer may be varied considerably as long as the haloethylene monomer constitutes at least 50% by weight of the total. For example, there may be used copolymers of from 50 to 99%, or more preferably from 70 to 95%, by weight of the haloethylene monomer, together with from 1 to 50%, more preferably from 5 to 30%, by weight of a vinyl ester, or an acrylic or methacrylic ester or any of the other monoolefinic materials mentioned above, or any two, three, four, or more of these.

Examples of suitable plasticizers for the haloethylene polymers are dioctyl sebacate, dibutoxy ethyl phthalate, acetyl tributyl citrate, butyle benzyl phthalate, dioctyl adipate, dioctyl azelate, dioctyl phthalate, dicapryl phthalate, dibutyl sebacate, or mixtures thereof. Other plasticizers which can be employed are hexachlorodiphenyl oxide, toluene sulfonamide-aldehyde resin, and a composition comprising a waterinsoluble thermoplastic cellulose ether, di-(4-tertiary butyl phenyl) monophenyl phosphate and di4-tertiary butyl phenyl) mono(5-tertiary butyl-2-xenyl) phosphate. Preferably plasticizers such as butyl benzyl phthalate, acetyl tributyl citrate, dibutoxy ethyl phthalate and other plasticizers which permit fusion at temperatures lower than 350° F., that is about 300° F. or lower, are used, singly or in combination, with higher fusion point plasticizers. The plasticizers are also used in amounts necessary to give the required flexibility in the fused polymer and in an amount necessary to afford putty-like to liquid-like masses. For example from about 40 to 60 parts by weight of plasticizer can be used with from 60 to 40 parts by weight of the polymer although for best results it is preferable that the plasticizer polymeric combination comprise from about 40 to 50 parts by weight of plasticizer with from 60 to 50 parts of the haloethylene containing polymer present.

The polymeric haloethylene compositions disclosed herein may also contain minor amounts of stabilizers such as basic lead carbonate, lead oxide, alkaline earth silicates lead silicate, lead stearate, titanium dioxide, lead phenolate, modified barium ricinoleate (Ferro 121) and the like. Desirably such stabilizers are used in an amount of from 0.1 to 10 parts by weight per 100 parts by weight of vinyl polymer. Other compounding ingredients may also be incorporated in the vinyl polymer or polymr composition such as, dyes and color pigments, minor amounts of rubbery butadiene-1,3 and acrylonitrile copolymers, and the like. Viscosity reducers such as triethanolamine, Sotex CW (compounds of long-chain fatty acid esters of multiple ether amine linkages), Santomerse S (salts of substituted aromatic sulfonic acids), Aerosol 18 (N-octadecyl disodium sulfosuccinamate), Aerosol OT (dioctyl sodium sulfosuccinamate), Yelkin TTS (an oil soluble commercial lecithin - 62% with soybean oil), Amine 220 (oil soluble, relatively water insoluble strongly cationic surface active liquid — b.p. 235° C. (1 mm. Hg.), Sp. Gr. 0.93–0.936; flash pt. 465° F.) and the like, in amounts of from about 1 to 2% by weight of the total gas-generating composition are desirably added to improve the castability or fluidity of the composition, especially where the viscosity of the polymer has been increased due to the employment of a plasticizer or plasticizer system which has reduced the fusion temperature of the polymer.

In preparing a gas-generating composition employing a haloethylene containing polymer, the polymer and a plasticizer, such as butyl benzyl phthalate are mixed together at room temperature with a viscosity reducer to form a plastisol which is subsequently mixed with the previously ground oxidizing agent containing the burning rate modifier and cast into suitable receptacles or molds and heated to about 300° F. and not over about 350° F. to fuse or set the haloethylene containing polymer. Where the plasticized polymer is somewhat viscous or a plastisol is not formed, mixing should be conducted on mill rolls at temperatures below 350° F. and preferably at about 300° F. and the hot gas-generating composition extruded into the desired shape or pressed into molds and allowed to cool below the set point.

Other rubbery materials capable of serving as binders for the gas-generating composition are natural rubber, such as caoutchouc and the like which is essentially a polymer of isoprene, or synthetic rubbers, such as the rubbery polymers of open-chain conjugated dienes having from 4 to 8 carbon atoms exemplified by butadiene-1,3; isoprene; 2,3-dimethyl butadiene-1,3; 1,4-dimethyl butadiene-1,3 and the like, or the rubbery copolymers of these and similar conjugated diolefins with each other or with at least one copolymerizable monomeric material such as acrylonitrile, methacrylonitrile, styrene, methyl acrylate, methyl methacrylate, ethyl acrylate, ethyl methacrylate, isobutylene, 2-vinyl pyridine, or similar materials or the rubbery polymers of other conjugated dienes, such as chloroprene and the like. The rubbery polymers generally contain at least 50% by weight of the conjugated diene, preferably from 55 to 85% by weight of the diene. Terpolymers employing at least 35% diene may also be used. Materials such as polyisobutylene and similar hydrocarbons can likewise be used. Mixtures of these rubbery materials can be used. Typical rubbers in the above groups well known to the art are Buna S, GR-S, Buna N, GR-A, Neoprene, Butyl and the like.

Various compounding ingredients well known to the art can be employed with the dienes and olefins mentioned above such as antioxidants, colors, accelerators, vulcanizing agents, extenders, etc. Examples of such compounding ingredients are phenyl beta naphthylamine, aldol alpha naphthylamine, polymerized trimethyl dihydroquinoline, 2-mercapto-benzothiazole disulfide, polyaralkylated phenols, triethyl trimethylene triamine, zinc oxide, MPC black, EPC black, stearic acid, coumarone-indene type resins, tetramethyl thiuram disulfide, tetraethyl thiuram disulfide, processing oils, sulfur, etc. In particular, the sulfur and zinc oxide should be employed in an amount sufficient to give a flexible, tough vulcanizate not a rigid mass such as ebonite when the polymer is unloaded. From 2–5 parts by weight of sulfur per 100 parts by weight of rubber will generally be sufficient.

In preparing a gas-generating composition employing a sulfur curable rubber or polychloroprene, the rubber, oxidizing agent and burning rate modifier are added to the plasticized polymer on the mill, the accelerator and curing agent added and the mass mixed for a short time, sheeted out and molded or cured under pressure at temperatures up to about 270–312° F. for various periods of time.

Nitrocellulose, if mixed with a monomer such as methyl acrylate, or acrylonitrile, compounded with ammonium perchlorate and the silicon-oxygen burning rate modifier of this invention and then the monomer polymerized, can also be used.

With any of the foregoing compositions there can be used pigment colors, dyes, fungicides, etc., as well as known burning rate modifiers such as carbon black, copper chromite (a mixture of copper and chromium compounds, etc., to enhance the improvement in burning rate afforded by the silicon-oxygen modifiers While it has been pointed out supra that it is more desirable to employ as binders those polymers which cure at relatively low temperatures and which contain linkages which are relatively unstable at high temperature to provide more rapid decomposition, it is apparent that sulfur and the like curable polymers are more readily obtainable and offer advantages costwise initially and during processing as compared to some of the less readily obtainable polymers.

It will be understood that the methods of blending the several polymeric binders with the oxidizing agent and burning rate modifier can be varied somewhat depending on the type of polymeric binder used, the amounts of materials, the type of equipment, etc. Moreover, it will be understood that while vinyl polymers are generally fused and the polyesterurethanes, acid group containing polymers and the dienes, etc. are cured, the word "curing" in the claims includes fusing a plasticized vinyl halide as well as curing, cross linking or vulcanizing one of the other polymers disclosed in the presence of a curing agent, by heat alone where a separately added curing agent is not necessary or at room temperature.

The molded or shaped cured composition may then be used as a gas generator but is preferably encased in a suitable container such as a metal case to protect it while being handled and from exposure to the weather. The composition may be secured to the inside walls of the container by means of an adhesive such as a cement comprising a chlorinated rubber or a cement comprising a mixture of chlorinated rubber and diene-carboxylic acid rubber, a polyvinyl chloride rubbery butadiene-1,3-acrylonitrile composition, polyesterurethane, or other rubber depending on the polymeric binder used in the composition, permitted to dry, and then fitted with conventional igniting apparatus.

The heterogeneous cured compositions of the present invention even though highly loaded with oxidizer exhibit very satisfactory physical properties for a gas generator. For example, they easily support their own weight, can be handled and used over a wide ambient temperature range of from about −65° to +175° F. without deformation, and are also chemically stable within this temperature range so that autoignition does not occur. They also exhibit good strength and elongation so that they can withstand considerable shock and high acceleration stresses without damage. Moreover, the composition exhibits a good burning rate and is substantially or entirely converted to low molecular weight gaseous products. For example, the linear burning rate of some of the compositions disclosed herein at 1,000 p.s.i.a. and 70° F. ambient temperature has been over 2.50 inch per second as compared to a maximum strand burning rate of 1 inch per second with conventional compositions. Some of the compositions of the present invention will exhibit burning rates as high as 6 inch/sec. at 70° F. and 4,000 p.s.i.a. The variation in burning rates affords the designer of gas-generating devices considerable latitude in their construction. Smaller devices and/or lower operating pressure devices can be produced as compared to conventional devices. Alternatively, conventional devices fitted with the present composition will exhibit greater thrust or load carrying capacity. In some instances the dead weight or casing for such devices can be reduced. Moreover, the physical properties of the compositions of the present invention are also equal to or better than those exhibited by conventional compositions.

The following examples will serve to illustrate the invention with more particularity to those skilled in the art:

EXAMPLE I

A plastic, rubbery copolymer was prepared by copolymerizing about 88.6 parts by weight of butadiene-1,3 with 11.3 parts by weight of methacrylic acid. Analysis showed that the resulting copolymer contained about 0.130 ephr (equivalents per hundred of rubber) of combined COOH. 100 parts by weight of the copolymer were then mixed on a 6 inches × 12 inches rubber mill with 576 parts by weight of dried ammonium perchlorate, added in increments and spherical, particulate silicon monoxide containing a minor amount of combined nitrogen and having a surface area of 300 $M^2/g$ and in an amount to give 0.6% by weight in the final composition. The ammonium perchlorate had previously been ground 50% at 3,500 r.p.m. and 50% at 7,000 r.p.m. in a SH Bantam Mikropulverizer. About 4 parts by weight of magnesium oxide were then mixed with the composition which was cured in an ASTM mold in a Preco laboratory press at 800–850 p.s.i. for 10 minutes at 165° F. Stressstrain determinations were then run on die cut 0.25 inches × 2.75 inches pieces using a Scott IP4 tester at 76° F. and 50% relative humidity. Pieces for strand (linear) burning, 6 inches × 0.1 inches × ¼inches, were cut from cured sheets, edges trimmed, and then restricted with three dips in a polyvinyl chloride-tricresyl phosphate-tetrahydrofuran solution. Four small holes accurately spaced were then drilled in each strand during support in a jig to accommodate fuse wires for 3-increment burning. The samples for strand burning were then burned under pressure of nitrogen gas in a strand burning bomb. This equipment included a 5,000 lb. working-pressure bomb equipped with electrical windings and mechanical refrigeration for temperature control. A back pressure regulator is provided to maintain constant pressure during burning. The bomb has an internal dimension of about 3 inches × 8 inches and is equipped with a quick opening closure head, through which pass insulated electrical leads for strand ignition and 3-increment timing and which support a holder for a strand and the necessary electrical terminals. A thermocouple in the bomb sidewall measures the ambient temperature of the strand. The bomb is embedded in type metal or other low melting point alloy or material for measuring ambient temperatures above room temperature. A 5-wire cable lead connects the bomb with electronic instrumentaion for strand firing, increment timing, temperature measurement and control. Results of physical tests on the composition showed that it had an ultimate tensile strength of 1,000 p.s.i. and an ultimate elongation of about 1%. Its liner burning rate was 2.52 in./sec. at 1,000 p.s.i.a., ambient temperature was 70° F. and average pressure exponent, "n", at 700–2,000 p.s.i. was 0.78. The pressure exponent is a measure of the effect of gas pressure on the burning rate (slope of the burning rate curve) and is desirably low.

EXAMPLE II

This example was the same as Example I, above, except that arc silica was used in place of silicon monoxide, the ammonium perchlorate was not ground prior to use and modified compositions were made containing a minor amount of stearic acid to improve elongation. The compositions were as follows:

| Composition | Parts $NH_4ClO_4$ | Parts Binder | Parts MgO | Parts Stearic Acid | % by Weight Arc Silica |
|---|---|---|---|---|---|
| "A" | 576 | 83.5 | 4.4 | 16.5 | — |
| "B" | 576 | 83.5 | 4.4 | 16.5 | 1.0 |

After compounding and curing, the compositions were tested and gave the following results:

| Composition | IP4 Tester | | Linear Burning rate, in./sec., at 70° F., 1,000 p.s.i.a. | Ave. Press. Coef., "n", 700–2,000 p.s.i.a. |
|---|---|---|---|---|
| | Ultimate Tensile p.s.i. | Ultimate Elongation % | | |
| "A" | 500 | 10 | 1.13 | 0.56 |
| "B" | 490 | 9 | 1.43 | 0.56 |

These results show that while the presence of stearic acid lowers somewhat the burning rate, the elongation is greatly improved. On the other hand the silicon monoxide will improve the burning rate of the same composition by as much as 25%.

EXAMPLE III

This example was the same as Example II, above, except that arc silica having a surface area of 230–250 $M^2/g$ was used in place of silicon monoxide and variations were made in the amounts of the other ingredients and in the preparation of the ammonium perchlorate. The compositions prepared are as follows:

| Composition | Parts of $NH_4ClO_4$ | Parts of Binder | Parts MgO | Parts of Stearic Acid | % by Weight of Arc Silica |
|---|---|---|---|---|---|
| "A" | 500 | 83.5 | 4.0 | 16.5 | 1.0 |
| "B" | 500 | 90.9 | 4.0 | 9.1 | 1.0 |
| "C" | 435 (1) | 96.1 | 4.0 | 3.9 | 2.1 |
| "D" | 435 (1) | 96.2 | 4.0 | 3.8 | — |

(1) Ground 100% at 16,000 r.p.m.

After compounding and curing, the compositions were tested and the results are shown below:

| Compo- | Ambient | Linear Burning Rate in./sec. | Ave. Pressure Coef. (700–2,000 |
|---|---|---|---|
| sition | Temp., ° F. | 1,000 p.s.i.a. | p.s.i.a.)"n" |
| "A" | 70 | 1.27 | 0.54 |
| "B" | 70 | 1.33 | 0.59 |
| "C" | 70 | 1.55 | 0.66 |
| "D" | 70 | 1.27 | 0.56 |

These results show that improvements in burning rates are obtained with arc silica in a composition containing a —COOH curable rubber and ammonium perchlorate. Moreover, while these compositions employed less perchlorate, their burning rates were higher than the composition of Example II without a burning rate modifier. Note that in the case of composition "C", the perchlorate was reduced to 435 parts yetwith only 2% of burning rate modifier, the composition exhibited the highest burning rate of the group. Compositions "C" and "D", also illustrate the fact that grinding of the perchlorate improves the burning rate of the composition.

EXAMPLE IV

This example was similar to Example III, above, except that variations were made in the composition which contained oleic acid in one case instead of stearic acid. The composition was also milled for about 15 minutes after all of the perchlorate had been added. The components of the composition are set forth below:

| Compo-sition | $NH_4ClO_4$ % | MgO % | Arc Silica % | Polymer % | Oleic Acid % | Stearic Acid % |
|---|---|---|---|---|---|---|
| "A" | 83.9 | 0.63 | 1.5 | 11.65 | 2.33 | — |
| "B" (1) | 83.9 | 0.63 | 1.5 | 11.65 | 2.33 | — |
| "C" | 83.5 | 0.53 | 1.5 | 12.05 | — | 2.42 |

(1) Added milling time 30 instead of 15 minutes.

After compounding and curing, the compositions were tested and exhibited the following results:

| Composition | Strand B.R., 1,000 p.s.i.a. 70° F., in./sec. | Press. Exp. "n" | Instron Tests at 5"/in./min. Max. Tens. p.s.i. | Elong. at Max. Tens,% | Mod. of Elast. p.s.i. |
|---|---|---|---|---|---|
| "A" | 2.08 | 0.71 | 745 | 41 | 15,500 |
| "B" | 2.28 | 0.73 | 1132 | 27 | 17,900 |
| "C" | 1.61 | 0.66 | 894 | 5.6 | 16,000 |

The above data show that increased milling time improves the strand burning rate and that the use of an unsaturated softener such as oleic acid also improves the strand burning rate of the composition.

EXAMPLE V

This example was similar to Example II, above, except that the ammonium perchlorate was not ground prior to use and the components and their amounts were varied somewhat. The added milling time was 15 minutes. After compounding and curing, the results obtained on test are shown below:

| $NH_4ClO_4$% | Arc Silica (230–250 $M^2$/g) % | Bal. Binder Comp. (*) | Strand B.R., 1,000 p.s.i.a. 70° F., in./sec. | Press. Exp. "n" | Instron Test 5"/in./min. Max. Tens., psi | Elong., % | Mod. of Elast., psi |
|---|---|---|---|---|---|---|---|
| 80 | 0 | 20 | 0.74 | 65 | 341 | 5 | 6,800 |
| 80 | 0.5 | 19.5 | 0.90 | 53 | 415 | 6 | 6,900 |
| 80 | 1.0 | 19 | 1.00 | 49 | 407 | 6 | 6,800 |
| 80 | 1.5 | 18.5 | 1.06 | 51 | 442 | 7 | 6,300 |
| 80 | 2.0 | 18 | 1.08 | 57 | 449 | 6 | 7,500 |
| 80 | 3.0 | 17 | 1.08 | 54 | Not determined | | |

(*) —COOH polymer - 83.3 parts, stearic acid - 16.7 parts and MgO - 3.7 parts.

The results obtained illustrate the fact that increasing amounts of arc silica in the above particular base composition up to about 3% improve the strand burning rate without materially affecting the physical properties of the composition.

EXAMPLE VI

The method of this example was the same as Example I, above, except that the binder used was a polyesterurethanediol polymer instead of a —COOH containing polymer and minor variations were made in the amounts of components used. The polyesterurethane was prepared by reacting a molar excess of ethylene glycol with adipic acid in a reactor at a temperature of about 185° C. for about 5 hours while being agitated. Heating of the mixture was then continued for 8 hours while slowly bubbling nitrogen gas through the mixture so that the acid number of the polyester was reduced to 10. The pressure on the system was reduced to 15–20 mm. of Hg. to remove gross excess of glycol. Nitrogen is then bubbled through the system with reduced pressure to obtain the desired molecular weight while heating for about 12–16 hours (glycol split out to get the desired molecular weight). At the end of the reaction period the polyester, polyethylene adipate, was removed from the reactor and a portion was analyzed and found to have a molecular weight of 1,400 and terminal hydroxyl groups. The polyester was then added to p-phenylene diisocyanate in the ratio of 1 mol polyester to 1.7 mols of diisocyanate in a resin kettle and heated to about 265° F. with agitation and while under a vacuum. At the end of the reaction period the p-phenylene diisocyanate polyester reaction product or polyesterurethane was cooled to room temperature when, as a liquid, it was poured into a Sigma Blade Baker Perkins mixer and ammonium perchlorate, mixed with a minor amount of a finely-divided silicon and oxygen-containing burning rate modifier (as shown in the table below) was added in increments to the polyesterurethane mix. The ammonium perchlorate was finely-divided and had previously been dried; one fourth of the perchlorate had been ground in a Bantam SH Mikropulverizer at 16,000 r.p.m. using an 0.020 inch screen. Mixing was conducted under vacuum for 25 minutes while the mixer was cooled to keep the batch temperature at about 77°

F. At the end of this initial mixing period 1,4-butanediol in the ratio of 0.6 mol of the diol to 1.0 mol of the polyester was added to the batch in the mixer and mixing was continued for another 10 minutes while cooling. The resulting soft "putty" or "dough", at a temperature of about 90° F., was next formed to the desired shape in Teflon-coated compression molds at a pressure of about 500 p.s.i. in a laboratory press and cured at 165° F. for 30 minutes. Additional compositions were prepared without a burning rate modifier and in which mixing was conducted in the atmosphere. Compositions were also prepared in which other silicon-oxygen modifiers were used and in which the amounts of the modifier were varied. The resulting compositions were tested in the manner shown in Example I. The compositions without a burning rate modifier exhibited tensile strengths of from about 415 to 721 p.s.i. and elongations of about 3 to 12.2% while the compositions containing a burning rate modifier exhibited tensile strength of from about 643 to 825 p.s.i. and elongations of 8.0 to 10.5%. Strand burning tests were also conducted and are shown below:

| $NH_4ClO_4$ % by weight | Burning Rate Modifier % by weight | Polyester-urethanediol polymer % by weight | Strand Burning Rate, 70° F., in/sec. 350 psia | 600 psia | 700 psia | 1,000 psia | >2,000 psia |
|---|---|---|---|---|---|---|---|
| 80 | — | 20 | 0.34 | None | None | None | None |
| 80 | — | 20 (1) | 0.33 | " | " | " | " |
| 82.5 | — | 17.5 (1) | (2) | 0.34 | " | " | " |
| 85 | — | 15 (1) | (2) | 0.37 | " | " | " |
| 80 | 0.1* | 19.9 | (2) | 0.44 | " | " | " |
| 79.6 | 0.2* | 20.4 | 0.33 | 0.38 | 0.39 | " | " |
| 79.5 | 0.5* | 20.0 | 0.46 | 0.65 | 0.71 | 0.84 | 0.90 at 1500 |
| 80 | 1.0** | 19 | 0.47 | 0.7 | 0.8 | 0.98 | 1.5 |
| 82.5 | 1.0* | 16.5 (1) | 0.55 | 0.78 | 0.85 | 1.10 | 1.6 |
| 80 | 1.0*** | 19.0 | 0.55 | 0.80 | 0.90 | 1.25 | 1.75 |
| 78.4 | 2.0* | 19.6 | 0.48 | 0.68 | 0.75 | 0.90 | 1.35 |

NOTES:
(1) Mixed in atmosphere
(2) Not determined
*Arc silica of a surface area of 230—250 $M^2/g$.
**Silicon monoxide (fibrous) - surface area 150 $M^2/g$.
***Silicon monoxide (spherical) - surface area 300 $M^2/g$.
(both silicon monoxides contained a minor amount of combined nitgrogen)

The results of this example show that polyesterurethanediol-ammonium perchlorate compositions without a silicon-oxygen containing burning rate modifier even though increased amounts of oxidizing agent are used have low burning rates and do not burn at gas pressures much above 600 p.s.i. On the other hand when only 0.1% by weight of a silicon-oxygen containing burning rate modifier such as arc silica is added an improvement in the burning rate is obtained. At 0.2% are silica, the compositions burns at a gas pressure of 700 p.s.i. When 1.0% by weight of the modifier is provided not only are increased burning rates obtained but burning is observed at gas pressures of up to 2,000 p.s.i. Mixing in vacuum improves the physical properties of the composition as to tensile strength and elongation.

EXAMPLE VII

In this example the amount of ground ammonium perchlorate was varied, the burning rate modifier was arc silica (surface area 230/250 $M^2/g$), and the binder was the polyesterurethane cured by means of the diol of Example VI, above. The procedure of Example VI was followed. After compounding, curing and testing the following data were obtained:

| Composition | $NH_4ClO_4$ % | Physical Properties: Arc Silica % | Binder % | Instron Tests, 5"/in./min.: Max. Tensile, p.s.i. | Elong., % | Mod. of Elast., p.s.i. |
|---|---|---|---|---|---|---|
| "A" | 65 | 1 | 34 | 587 | 19 | 6,900 |
| "B" | 70 | 1 | 29 | 572 | 15 | 6,500 |
| "C" | 75 | 1 | 24 | 743 | 13 | 15,000 |
| "D" | 81 | 1 | 18 | 1,093 | 18 | 15,100 |

| Composition | Burning Rates: Strand Burning Rates at 70° F., in./sec. 300 psia | 450 psia | 750 psia | 1,000 psia | 1,500 psia | 2,000 psia |
|---|---|---|---|---|---|---|
| "A" | 0.25 | 0.31 | 0.36 | 0.36 | 0.36 | 0.35 |
| "B" | 0.35 | 0.44 | 0.54 | 0.59 | 0.60 | 0.60 |
| "C" | 0.41 | 0.53 | 0.69 | 0.78 | 0.90 | 0.94 |
| "D" | 0.46 | 0.61 | 0.85 | 1.02 | 1.23 | 1.36 |

These results illustrate the fact that the burning rates of the modifier containing composition tend to exhibit a "plateau" effect as the pressures and burning rates increase at the lower levels of ammonium perchlorate, i.e., Compositions "A" and "B". This leveling off in the burning rate of the composition at increasing gas pressures is of advantage in the manufacture and control of devices using the composition as compared to many conventional compositions where as the gas pressure increases so does the burning rate to result in compositions which are difficult to control without carrying out certain processing or design steps.

EXAMPLE VIII

Polyvinyl chloride was mixed at room temperature with dioctyl sebacate and then with ammonium perchlorate. The resulting composition was cast into molds and fused at 350° F. and samples thereof tested as to strand burning according to the method of Example I, above. Additionally compositions were also prepared and tested containing silicon-oxygen containing burning rate modifiers. The results on test are shown below:

| Parts by Weight | | | | | | |
|---|---|---|---|---|---|---|
| PVC | DOS | Ferro 121* | $NH_4ClO_4$** | Burning Rate Mod. | Burning Rate in./sec., 1,000 p.s.i.a. 70° F. | Pressure Exponent "n" |
| 12.5 | 12.5 | 0.5 | 75 | — | 0.33 | 0.34 |
| 12.5 | 12.5 | 0.5 | 75 | 1.0(1) | 0.38 | 0.41 |
| 12.5 | 12.5 | 0.5 | 75 | 1.0(2) | 0.42 | 0.31 |

(1)Arc silica, surface area - 230–250 $M^2/g$.
(2)Silicon monoxide, particulate, surface ara - 300 $M^2/g$.
*Barium ricinoleate composition
**Coarse grind Replacement of 25% of the dioctyl sebacate with butyl benzyl phthalate reduced the fusion point to about 300° F. Although the resulting composition then became viscous so that it was necessary to press it into the desired shape, it could still be pressed readily into a satisfactory gas-generating composition. Addition of 1% by weight of the total composition of Aerosol OT (dioctyl sodium sulfosuccinate) to the DOS-BBP plasticized resin composition enabled it to be cast and fused into a satisfactory composition at about 300° F. When the polyvinyl chloride polymer was replaced with a polymer such as a 90 vinyl chloride —10 vinyl acetate copolymer, similar results were obtained. The use of a 95 vinyl chloride —5 ethylene copolymer as a substitute for the polyvinyl chloride was also satisfactory except that a viscosity reducer was also needed to obtain a plastisol. This example shows that highly loaded useful compositions can be obtained and can be improved as to their burning rates by the incorporation of a minor amount of a silicon-oxygen containing burning rate modifier. The tensile strengths and elongations of the resulting compositions were satisfactory.

In summary, the present invention teaches that a minor amount of a high surface area, finely-divided essentially anhydrous inorganic silicon and oxygen-containing compound, for example, a compound such as arc silica, silicon monoxide, fume silica and silicon oxyimide will greatly increase the linear burning rates and burning per se at elevated pressures of ammonium perchlorate-organic rubbery binder gas-generating compositions. Moreover, highly satisfactory results are obtained when the composition comprises a polyesterurethane or combined curable acid group containing polymer as the binder. The compositions are readily processed at low temperatures to provide strong, shock and impact resistant articles. The novel gas-generating composition of the present invention containing a silicon-oxygen burning rate modifier will have many uses in producing gas for spraying purposes, pyrotechnic devices, rivet guns, for propelling various devices and the like and generally wherever a large amount of gas is needed to drive various machines and other apparatus.

What is claimed is:

1. A composition of matter useful in generating large volumes of gas on combustion and, except for minor amounts of compounding ingredients, consisting essentially of from about 70 to 87% by weight of finely-divided, dried ammonium perchlorate, from about 0.5 to 5.0% by weight of at least one high surface area finely-divided essentially anhydrous inorganic silicon and oxygen containing burning rate modifier selected from the group consisting of silicon monoxide, fume silica, arc silica and silicon oxyimide, and the balance a combustible organic elastomeric polymeric binder selected from the group consisting of a cured polyesterurethane of an organic diisocyanate and hydroxyl terminated polyester of a dibasic acid and a glycol and a polymer comprising predominantly linear carbon chains cured through at least a portion of its combined curable acid groups selected from the class consisting of COOH, $SO_3H$ and $PO_3H_2$ radicals.

2. An article of manufacture useful as a gas generator and comprising a container having an outlet and supported and adapted to burn within said container and adhere to the walls of said container a mixed, shaped and cured composition of matter characterized by generating large volumes of gas on combustion and, except for minor amounts of compounding ingredients, consisting essentially of from about 70 to 87% by weight of finely-divided dried ammonium perchlorate, from about 0.5 to 5.0% by weight of at least one high surface area finely-divided essentially anhydrous inorganic silicon and oxygen-containing burning rate modifier selected from the group consisting of silicon monoxide, fume silica, arc silica and silicon oxyimide, and the balance a combustible organic elastomeric polymeric binder selected from the group consisting of a cured polyesterurethane of an organic diisocyanate and a hydroxyl terminated polyester of a dibasic acid and a glycol and a polymer comprising predominantly linear carbon chains cured through at least a portion of its combined curable acid groups selected from the class consisting of COOH, $SO_3H$, $SO_2H$ and $PO_3H_2$ radicals.

3. The method of making a composition useful in generating large volumes of gas on combustion which comprises mixing together to obtain a thorough dispersion from about 70 to 87% by weight of dried ammonium perchlorate, from about 0.5 to 5.0% by weight of at least one high surface area finely-divided essentially anhydrous inorganic silicon and oxygen-containing burning rate modifier selected from the group consisting of silicon monoxide, fume silica, arc silica and silicon oxyimide, and, as the balance except for minor amounts of compounding ingredients, a combustible organic elastomeric polymeric binder selected from the group consisting of a polyesterurethane of an organic diisocyanate and a hydroxyl terminated polyester of a dibasic acid and a glycol and a polymer comprising predominantly linear carbon chains having combined curable acid groups selected from the class consisting of COOH, $SO_3H$, $SO_2H$ and $PO_3H_2$ radicals, shaping the resulting dispersion and curing the same, the temperature during mixing, shaping and curing being at least 100° F. below the auto-ignition point of the composition.

* * * * *